US008596081B2

(12) United States Patent
Bram et al.

(10) Patent No.: US 8,596,081 B2
(45) Date of Patent: Dec. 3, 2013

(54) VALVE ASSEMBLY WITH AN INTEGRATED HEADER

(75) Inventors: Leo Bram, Augustenborg (DK); Claus Thybo, Soenderborg (DK); Lars Finn Sloth Larsen, Sydals (DK)

(73) Assignee: Danfoss A/S, Nordborg (DK)

( * ) Notice: Subject to any disclaimer, the term of this patent is extended or adjusted under 35 U.S.C. 154(b) by 387 days.

(21) Appl. No.: 12/995,927

(22) PCT Filed: Jun. 3, 2009

(86) PCT No.: PCT/DK2009/000130

§ 371 (c)(1),
(2), (4) Date: Jan. 25, 2011

(87) PCT Pub. No.: WO2009/146705

PCT Pub. Date: Dec. 10, 2009

(65) Prior Publication Data

US 2011/0127008 A1 Jun. 2, 2011

(30) Foreign Application Priority Data

Jun. 4, 2008 (DK) ..... 2008 00770

(51) Int. Cl.
*F25B 41/04* (2006.01)

(52) U.S. Cl.
USPC ..... 62/225; 62/527

(58) Field of Classification Search
USPC ..... 62/225, 527, 224, 223, 222, 127; 137/625.48, 625.14, 625.15; 251/56, 251/63.5; 236/92 B, 91 D
See application file for complete search history.

(56) References Cited

U.S. PATENT DOCUMENTS

| | | | |
|---|---|---|---|
| 2,144,898 | A | 1/1939 | Shrode |
| 2,491,905 | A | 5/1944 | Ray |

(Continued)

FOREIGN PATENT DOCUMENTS

| | | | |
|---|---|---|---|
| DE | 174075 | | 7/1906 |
| EP | 1104879 | A1 | 6/2001 |
| JP | 60132179 | A | 7/1985 |

OTHER PUBLICATIONS

International Search Report for PCT/DK2009/000130 dated Sep. 18, 2009.

*Primary Examiner* — Mohammad M Ali
(74) *Attorney, Agent, or Firm* — McCormick, Paulding & Huber LLP

(57) ABSTRACT

A valve assembly (1) comprising an inlet opening, a distributor and an outlet part comprising at least two outlet openings. The distributor comprises an inlet part (5) fluidly connected to the inlet opening, and is arranged to distribute fluid medium received from the inlet opening to at least two parallel flow paths, preferably of a heat exchanger (3). The valve assembly (1) further comprises a first valve part and a second valve part arranged movable relative to each other in such a manner that the mutual position of the valve parts determines the fluid flow from the inlet opening to each of the outlet openings of the outlet part. Finally, the valve assembly (1) comprises a header (2) forming an integral part of the valve assembly (1). The header (2) is arranged to form an interface towards a heat exchanger (3) comprising at least two flow paths, and it provides fluid connections in such a manner that each of the outlet openings (7, 9) is fluidly connected to a flow path of a heat exchanger (3) connected to the header (2). The valve assembly (1) improves the distribution of fluid medium between the flow channels of the heat exchanger (3).

11 Claims, 4 Drawing Sheets

(56) References Cited

U.S. PATENT DOCUMENTS

| | | | | | |
|---|---|---|---|---|---|
| 2,379,286 | A | * | 6/1945 | Dodson | 62/205 |
| 2,637,985 | A | | 5/1953 | Ray | |
| 2,771,092 | A | | 11/1956 | Schenk | |
| 3,633,379 | A | | 1/1972 | Nielson | |
| 3,683,637 | A | * | 8/1972 | Oshima et al. | 62/225 |
| 3,744,269 | A | * | 7/1973 | Oshima et al. | 62/212 |
| 3,883,051 | A | * | 5/1975 | Bailey | 223/51 |
| 4,700,770 | A | | 10/1987 | Bolmstedt et al. | |
| 5,025,641 | A | * | 6/1991 | Broadhurst | 62/347 |
| 5,658,459 | A | * | 8/1997 | Guttormsen | 210/279 |
| 5,806,586 | A | | 9/1998 | Osthues et al. | |
| 6,199,401 | B1 | * | 3/2001 | Haussmann | 62/525 |
| 6,267,173 | B1 | | 7/2001 | Hu et al. | |
| 6,416,032 | B2 | * | 7/2002 | Oh | 251/14 |
| 6,481,229 | B1 | * | 11/2002 | Yajima et al. | 62/225 |
| 6,804,975 | B2 | * | 10/2004 | Park | 62/324.1 |
| 6,997,437 | B2 | * | 2/2006 | Mitten | 251/214 |
| 7,143,605 | B2 | | 12/2006 | Rohrer et al. | |
| 7,174,726 | B2 | * | 2/2007 | Grau et al. | 62/115 |
| 7,805,961 | B2 | * | 10/2010 | Choi et al. | 62/513 |
| 2006/0108011 | A1 | | 5/2006 | George et al. | |

* cited by examiner

VALVE ASSEMBLY WITH AN INTEGRATED HEADER

CROSS REFERENCE TO RELATED APPLICATIONS

This application is entitled to the benefit of and incorporates by reference essential subject matter disclosed in International Patent Application No. PCT/DK2009/000130 filed on Jun. 3, 2009 and Danish Patent Application No. PA 2008 00770 filed on Jun. 4, 2008.

FIELD OF THE INVENTION

The present invention relates to a valve assembly, e.g. for use in a refrigeration circuit, e.g. forming part of an air condition system. More particularly, the valve assembly of the present invention is adapted to be connected to or integrated in a heat exchanger.

BACKGROUND OF THE INVENTION

Refrigeration systems, such as air condition systems, are usually provided with a refrigerant path comprising one or more compressors, a condenser, an expansion device, e.g. in the form of an expansion valve, and an evaporator, e.g. in the form of a heat exchanger. Thus, the heat exchanger normally receives refrigerant from the expansion device in a mixed liquid/gaseous state. In the case that the heat exchanger is of the kind having at least two parallel flow paths it is further necessary to provide a distributor in the refrigerant path adjacent to the heat exchanger in order to distribute refrigerant between the parallel flow paths of the heat exchanger. Such a distributor may be in the form of a header mounted on or forming an integral part of the heat exchanger.

U.S. Pat. No. 7,143,605 discloses a flat-tube evaporator including an inlet manifold and an outlet manifold separated a distance from the inlet manifold. A distributor tube is positioned within the inlet manifold and fluidly connected to the common distributor. A plurality of flat tubes are positioned to fluidly connect the inlet manifold and the outlet manifold. The distributor tube can include a plurality of orifices, each of the plurality of orifices positioned to direct the refrigerant into the inlet manifold in a first direction.

U.S. Pat. No. 5,806,586 discloses a device for distributing a two-phase refrigerating medium mass flow in a plate evaporator. The evaporator has a distribution channel at the inlet side which may receive a refrigerating medium mass flow coming from an expansion valve and several mutually spaced exchanger channels which branch off from the distribution channel in a substantially perpendicular direction. In order to ensure a uniform distribution of the refrigerant medium mass flow among the exchanger channels, a porous body is arranged in the distribution channel between the refrigerating medium inlet and the branch-off points of the exchanger channels. The porous body may be arranged in an outer throttle insert which extends over at least part of the length of the distribution channel and in whose wall are located additional throttle openings that lead to the exchanger channels.

The distributors disclosed in U.S. Pat. No. 7,143,605 and U.S. Pat. No. 5,806,586 are both connected to an expansion device in such a manner that they receive refrigerant in a two-phase state.

SUMMARY OF THE INVENTION

It is an object of the invention to provide a valve assembly providing an improved distribution of refrigerant between at least two flow paths of a heat exchanger.

It is a further object of the invention to provide a valve assembly in which the number of required parts can be reduced.

It is an even further object of the invention to provide a valve assembly in which the manufacturing costs can be reduced.

It is an even further object of the invention to provide a valve assembly in which the risk of leaks occurring is reduced as compared to similar prior art valve assemblies.

According to the invention the above and other objects are fulfilled by providing a valve assembly comprising:

- an inlet opening adapted to receive fluid medium in a liquid state,
- a distributor comprising an inlet part fluidly connected to the inlet opening, the distributor being arranged to distribute fluid medium received from the inlet opening to at least two parallel flow paths,
- an outlet part comprising at least two outlet openings, each being adapted to deliver a fluid medium in an at least partly gaseous state,
- a first valve part and a second valve part arranged movable relative to each other in such a manner that the mutual position of the valve parts determines the fluid flow from the inlet opening to each of the outlet openings of the outlet part,
- a header forming an integral part of the valve assembly, said header being arranged to form an interface towards a heat exchanger comprising at least two flow paths, and said header providing fluid connections in such a manner that each of the outlet openings is fluidly connected to a flow path of a heat exchanger connected to the header.

The inlet opening is adapted to receive fluid medium. Thus, the inlet opening is preferably fluidly connected to a source of fluid medium.

The valve assembly of the invention defines flow paths between the inlet opening and the at least two outlet openings. Fluid medium in a liquid state is received at the inlet opening and fluid medium in an at least partly gaseous state is delivered at the outlet openings. In the present context the term 'liquid state' should be interpreted to mean that the fluid medium entering the valve assembly via the inlet opening is substantially in a liquid phase. Similarly, in the present context the term 'at least partly gaseous state' should be interpreted to mean that the fluid medium leaving the valve assembly via the outlet openings is completely in a gaseous phase, or that the fluid medium comprises a mixture of gaseous and liquid medium, i.e. a part of the volume of the fluid medium leaving the valve assembly is in a gaseous phase and part of the fluid medium is in a liquid phase. Accordingly, at least a part of the fluid medium entering the valve assembly undergoes a phase transition from the liquid phase to the gaseous phase when passing through the valve assembly.

The inlet opening and the outlet openings may preferably be fluidly connected to one or more other components, such as other components of a refrigeration system, preferably in such a manner that the valve assembly is connected directly to or forms part of a heat exchanger. The valve assembly may advantageously form part of a flow system, such as a flow circuit. In this case the fluid medium may advantageously be a suitable refrigerant, such as a refrigerant selected from one of the following groups of refrigerants: HFC, HCFC, CFC or HC. Another suitable refrigerant is $CO_2$ The valve assembly comprises a distributor arranged to distribute fluid medium received from the inlet opening to at least two parallel flow paths. The flow paths are parallel in the sense that fluid can flow along the flow paths in a parallel manner, i.e. they are arranged fluidly in parallel. The distributor ensures that the fluid medium received at the inlet opening is distributed among the outlet openings in a predetermined and desired manner.

The valve assembly further comprises a first valve part and a second valve part. The valve parts are arranged movably relative to each other. This may be achieved by mounting the first and/or the second valve part in a manner which allows it/them to move relative to the remaining parts of the valve assembly. Thus, the first valve part may be movable while the second valve part is mounted in a fixed manner. As an alternative, the second valve part may be movable while the first valve part is mounted in a fixed manner. Finally, both of the valve parts may be movably mounted. In all of the situations described above a relative movement between the first valve part and the second valve is possible, thereby defining a mutual position of the first valve part and the second valve part. This mutual position determines the fluid flow from the inlet opening to each of the outlet openings. Thus, a desired fluid flow can be obtained by adjusting the mutual position of the valve parts. This will be described in further detail below.

The valve assembly further comprises a header which is arranged to form an interface towards a heat exchanger comprising at least two flow paths. Thus, fluid medium can be delivered to the flow paths of such a heat exchanger via the header. The header provides fluid connections in such a manner that each of the outlet openings is fluidly connected to a flow path of a heat exchanger connected to the header. A one-to-one correspondence between the outlet openings and the flow paths of the heat exchanger may exist, i.e. a given outlet opening may deliver fluid medium to one flow path, and each flow path may receive fluid medium from only one outlet opening. Alternatively, a given outlet opening may be arranged to deliver fluid medium to two or more flow paths, and/or a given flow path may receive fluid medium from two or more outlet openings. This will be described in further detail below.

The header forms an integral part of the valve assembly. This should be interpreted to mean that the header, besides the normal functions of a header, plays a part in the operation of the valve assembly. Thus, it is not possible to remove the header from the valve assembly without significantly affecting the operation of the valve assembly, possibly to the extent that the valve assembly becomes inoperable if the header is removed.

It is an advantage that the header forms an integral part of the valve assembly because the requirement for a separate distributor and distributor tubes is avoided. Thereby the number of components is reduced, thereby reducing the manufacturing costs. Furthermore, it is easier to design the valve assembly in such a manner that a desired, e.g. uniform, distribution of fluid medium among the flow paths of the heat exchanger is obtained. The efficiency of the heat exchanger can thereby be improved, and the heat exchanging capacity of the fluid medium can be utilised in a more optimal manner. In the case that the valve assembly is arranged in a refrigeration system, the costs involved with operating the refrigeration system are reduced, and the system can be operated in a more environment friendly manner.

The header may form part of the distributor. According to this embodiment the header is shaped and positioned in such a manner that it plays a part in distributing fluid medium from the inlet opening among the at least two parallel flow paths. To this end the header may be provided with a number of openings arranged to guide fluid medium towards the at least two parallel flow paths.

Alternatively or additionally, the header may form part of the first valve part or the second valve part. According to this embodiment the header is arranged in such a manner that relative movements between the header and one of the valve parts can be performed. Thus, in the case that the header forms part of the first valve part relative movements between the header and the second valve part can be performed. Similarly, in the case that the header forms part of the second valve part relative movements between the header and the first valve part can be performed. As described above, the header may be movable relative to the remaining parts of the valve assembly and/or the other valve part may be movable relative to the remaining parts of the valve assembly. Since the header, according to this embodiment, forms part of the one of the valve parts, the header is arranged at a position where expansion of the fluid medium takes place. This has the advantage that the delivery of the fluid medium to the heat exchanger by the header takes place either before or during expansion of the fluid medium. This makes it easier to control the distribution of fluid medium among the at least two flow paths of the heat exchanger, e.g. in order to obtain a uniform distribution, e.g. in terms of the mixture of liquid and gaseous fluid medium delivered to each of the flow paths of the heat exchanger. Furthermore, it makes the valve assembly suitable for use in flow systems of the microchannel type.

The valve assembly may further comprise a heat exchanger connected to the header. According to this embodiment a heat exchanger is arranged immediately adjacent to the header. The heat exchanger may be integrated with the header. Alternatively, the heat exchanger may be attached to the header.

The first valve part may comprise a plurality of openings and the second valve part may comprise at least one opening, and the fluid flow from the inlet opening to each of the outlet openings may be determined by a mutual position of the openings of the first valve part and the opening(s) of the second valve part. The mutual position of the openings may, e.g., determine whether or not fluid medium is allowed to pass through a given opening of the first valve part and a given opening of the second valve part and/or to which extent such passage is allowed.

The mutual position of the openings may determine a degree of opening of the valve assembly. According to this embodiment the opening degree of the valve assembly, and thereby the amount of fluid medium allowed to pass the valve assembly, can be adjusted by adjusting the mutual position of the first valve part and the second valve part, and thereby the mutual position of the openings.

The openings of the first valve part and the opening(s) of the second valve part may be arranged in such a manner that openings of the first valve part and opening(s) of the second valve part can be arranged at least partly overlappingly in response to a mutual movement of the first valve part and the second valve part. The openings may each be fluidly connected to one of the outlet openings, and the mutual position of the valve parts may define opening degrees of the valve assembly towards the outlet openings.

When performing mutual movements between the first valve part and the second valve part, the mutual positions of the openings formed in the two valve parts is changed. Thus, the overlap between a given opening of the first valve part and a given opening of the second valve part is determined by the mutual position of the first valve part and the second valve part. The larger the overlap, the larger a resulting opening defined by the two openings must be expected to be. This resulting opening may advantageously define the opening degree of the valve assembly towards the corresponding outlet opening. According to this embodiment the number of openings of the first valve part may advantageously be equal to the number of openings of the second valve part, and the openings are preferably positioned in such a manner that pairs of corresponding openings in the first and second valve part are defined. The degree of overlap between each pair of openings is preferably substantially the same.

A correspondence between opening degree of the valve assembly and mutual position of the first valve part and the second valve part may alternatively or additionally be defined by a geometry of the first valve part and/or a geometry of the second valve part. Such a geometry may be or comprise size and/or shapes of openings defined in the first and/or second valve part, size and/or shape of valve elements/valve seats formed on the first and/or second valve parts, and/or any other suitable geometry.

Alternatively, the mutual position of the openings may determine a distribution of fluid flow among the outlet openings. According to this embodiment, the second valve part may advantageously comprise only one opening. When relative movements of the first valve part and the second valve part are performed the opening of the second valve part can then be moved alternatingly between positions where it overlaps with the openings of the first valve part. When the opening of the second valve part is positioned overlappingly with a given opening of the first valve part, fluid medium is delivered to the flow path corresponding to this opening, but not to the flow paths corresponding to the other opening(s) of the first valve part. Thereby the amount of fluid medium which is delivered to each of the flow paths can be controlled by controlling the time during which the opening of the second valve part is arranged overlappingly with each of the openings of the first valve part. Thereby the distribution of fluid medium among the flow paths can be controlled.

At least some of the openings may be microchannels.

The first valve part and the second valve part may be adapted to perform substantially linear relative movements. According to this embodiment, the valve parts may be arranged slidingly relative to each other, e.g. one of the valve parts being a tube having the other valve part arranged slidingly inside.

Alternatively, the first valve part and the second valve part may be adapted to perform substantially rotational relative movements. According to this embodiment, the valve parts may advantageously be in the form of two disks arranged in such a manner that mutual rotational movements can be performed. As an alternative, one of the valve parts may be a tube having the other valve part arranged inside in such a manner that mutual rotational movements about a common longitudinal axis can be performed.

The valve assembly may further comprise an actuator adapted to cause relative movements of the first valve part and the second valve part. The actuator may, e.g., be of a kind comprising a thermostatic valve. Alternatively, the relative movements of the valve parts may be driven by a step motor, a solenoid, or any other suitable means.

The header may comprise one or more separating parts defining at least two sections of the header, each of said sections being fluidly connected between the distributor and the interface towards the heat exchanger. According to this embodiment, the fluid medium is initially distributed among the sections of the header. From each of the sections the fluid medium is further distributed towards the outlet openings and the parallel flow paths of the heat exchanger.

It is often the case that a heat exchanger and a header are arranged in such a manner that the inlets of the parallel flow paths of the heat exchanger are distributed along a direction which is defined by the force of gravity. In this case, when fluid medium in a mixed liquid/gaseous state is supplied to the heat exchanger the distribution of the liquid medium and the gaseous medium among the flow paths is very uneven in the sense that the flow paths arranged at the lowest position receives much more liquid medium than the flow paths arranged at the highest position. This results in a poor utilisation of the heat exchanging capacity of the heat exchanger.

It is an advantage to divide the header into at least two sections because it is thereby possible to guide fluid medium of a more appropriate and uniform mixture of liquid and gaseous medium to each of the sections. When the fluid medium is subsequently distributed further on to the flow paths of the heat exchanger, the distribution of liquid and gaseous medium among the flow paths is more uniform, and an improved utilisation of the heat exchanging capacity of the heat exchanger is thereby obtained.

Each of the sections may be fluidly connected to at least one microchannel. It is an advantage to distribute fluid medium to the microchannels via the sections because the requirements to the accuracy of alignment between the microchannels and the header are thereby reduced. This reduces the manufacturing costs of the system.

Alternatively or additionally, each of the sections may be connected to at least two outlet openings. According to this embodiment the fluid medium is initially distributed to the at least two sections. Subsequently, the fluid medium is distributed from each of the sections to at least two outlet openings. Thereby the fluid medium is distributed to the outlet openings in two steps. This further improves the distribution of fluid medium among the flow paths in terms of obtaining a more uniform distribution.

BRIEF DESCRIPTION OF THE DRAWINGS

The invention will now be described in further detail with reference to the accompanying drawings in which.

DETAILED DESCRIPTION OF THE PREFERRED EMBODIMENT

Figure 1:
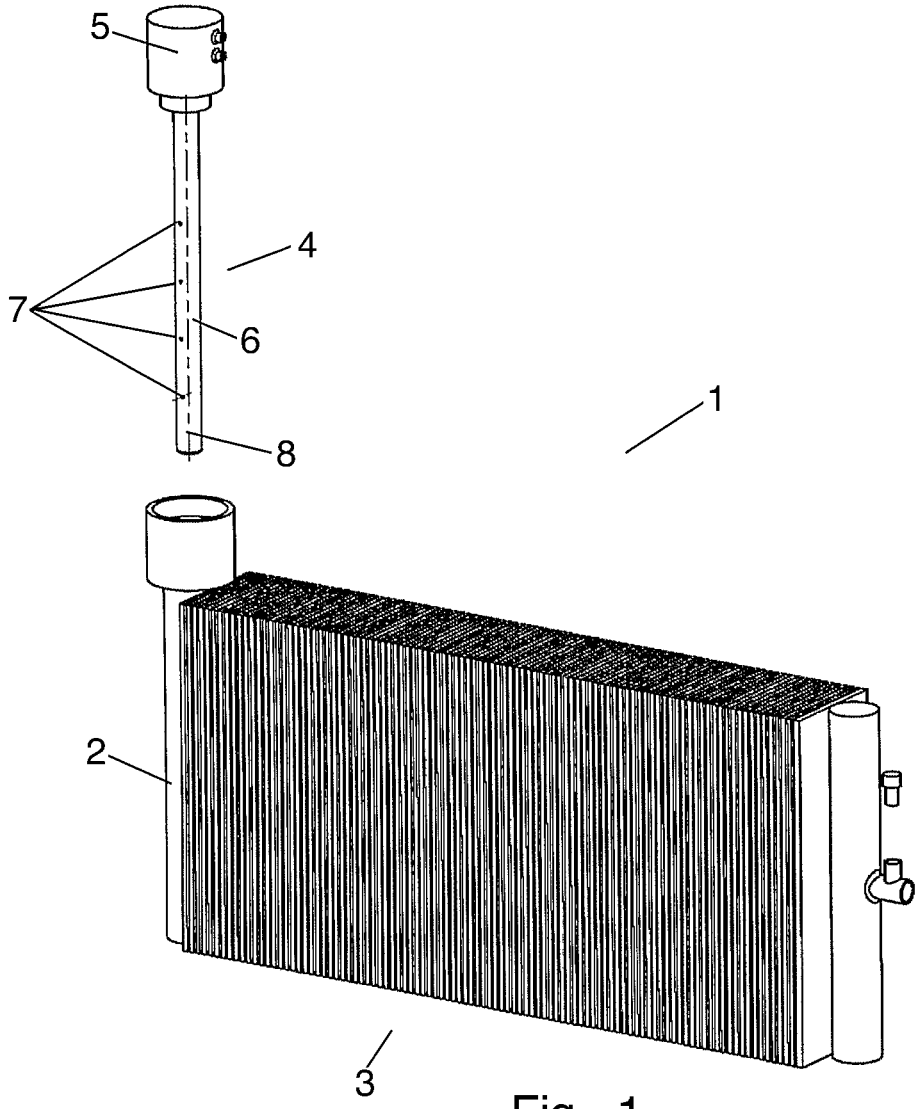
FIG. 1 is a perspective, exploded view of a valve assembly according to an embodiment of the invention, FIG. 2 a side view of the valve assembly of FIG. 1.

FIG. 1 is a perspective, exploded view of a valve assembly 1 according to an embodiment of the invention. The valve assembly 1 comprises a header 2 connected to a heat exchanger 3. The heat exchanger 3 is of a kind comprising a number of parallel flow paths (not shown), and the header 2 is arranged to deliver fluid medium to the flow paths. The valve assembly 1 further comprises a distributor part 4 which is adapted to be inserted into the header 2. However, for the sake of clarity the distributor part 4 is shown at a position above the header 2.

The distributor part 4 comprises an inlet section 5 adapted to receive fluid medium in a substantially liquid state. The distributor part 4 further comprises an elongated section 6 being provided with four openings 7, each being adapted to deliver fluid medium in a manner which will be described in further detail below.

The distributor part 4 is adapted to be inserted into the header 2 in a movable manner. Thus, the distributor part 4 can be rotated about longitudinal axis 8 and/or it can be moved linearly along the longitudinal axis 8. Thereby the positions of the openings 7 relative to the header 2 are shifted. This will be described in further detail below.

Figure 2:
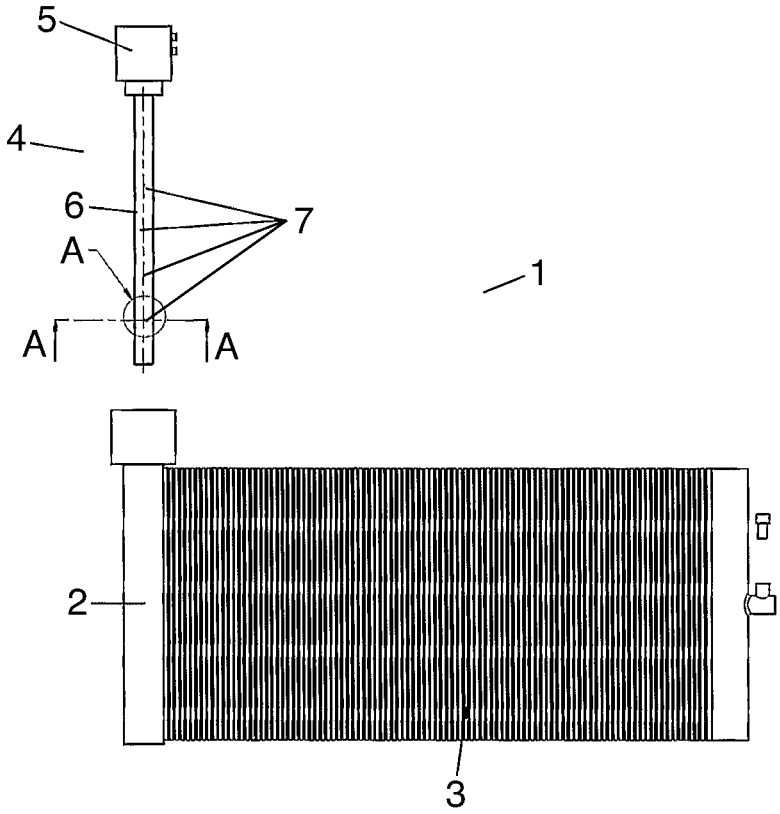
Figure 3:
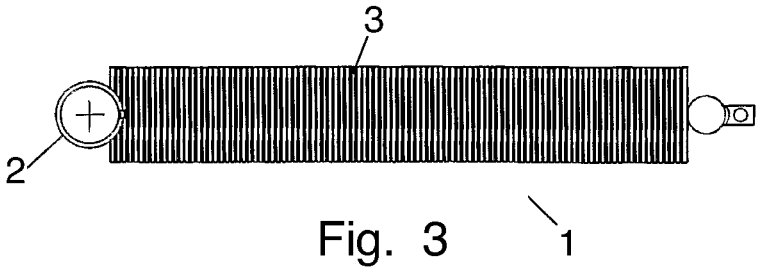
FIG. 3 is a view from above of the valve assembly of FIGS. 1 and 2.

FIG. 2 is a side view of the valve assembly 1 of FIG. 1, and FIG. 3 is a view from above of the valve assembly 1 of FIG. 1.

Figure 4:
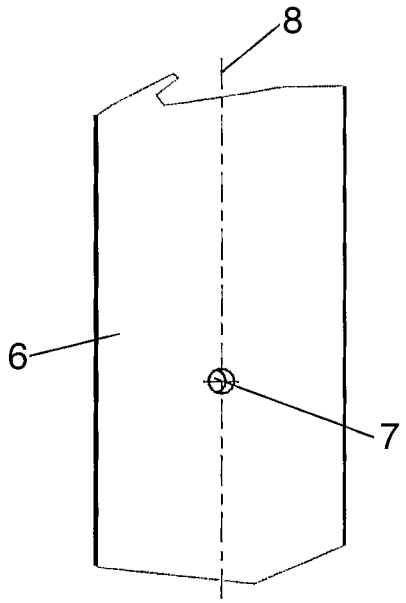
FIG. 4 is a detail of the valve assembly of FIG. 2.

FIG. 4 shows a detail of the valve assembly 1 of FIGS. 1-3, more particularly the detail indicated by circle A shown in FIG. 2. Thus, FIG. 4 clearly shows one of the openings 7 formed in the elongated section 6.

Figure 5:
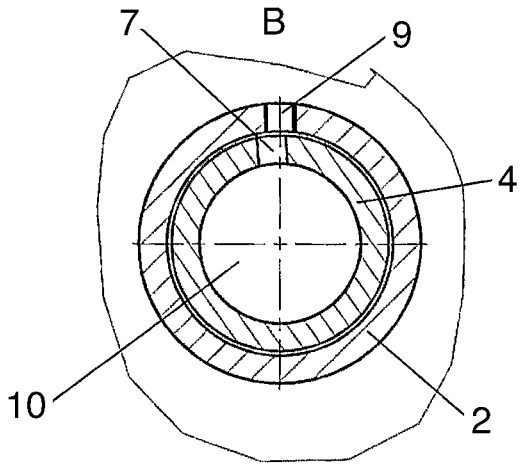
FIG. 5 is a cross sectional view of the valve assembly of FIG. 2 along the line A-A.

FIG. 5 is a cross sectional view of the valve assembly of FIGS. 1-3 along the line A-A indicated in FIG. 2, i.e. at the position of one of the openings 7. The distributor part 4 is appropriately arranged inside the header 2. Thus, FIG. 5 shows the distributor part 4 inside the header 2, one of the openings 7 formed in the distributor part 4 and an opening 9 formed in the header 2. The openings 7, 9 are arranged slightly displaced relative to each other. Thereby the overlap between the openings 7, 9 is smaller than the area of each of the openings 7, 9.

During operation fluid medium in a liquid state is supplied to the distributor part 4 via an interior channel 10. The fluid medium is then distributed to a section (not shown) of the header 2 via the openings 7 and 9, respectively. From the section the fluid medium is distributed further on towards the flow channels of the heat exchanger in a manner which will be described further below. Thereby the distributor part 4 and the header 2 in combination define a distributor. The relative position of the distributor part 4 and the header 2 determines the relative positions of the openings 7 and 9, and thereby the degree of overlap between the openings 7 and 9. Accordingly, the relative position of the distributor part 4 and the header 2 determines the size of the passage which the fluid medium is allowed to pass through from the interior channel 10 to the section.

The passage defined by the overlap between the openings 7 and 9 further functions as an expansion valve. Accordingly, when the fluid medium in a liquid form passes through the openings 7, 9 at least part of the fluid medium undergoes a phase transition, and the fluid medium leaving the header 2 and entering the section is therefore in a mixed liquid/gaseous state or in a completely gaseous state. Thus, the distributor part 4 and the header 2 function as valve parts which are movable relative to each other. As described above the relative position of the distributor part 4 and the header 2 defines the degree of overlap between the openings 7, 9, and thereby the degree of opening of the expansion valve formed by the distributor part 4 and the header 2.

Figure 6:
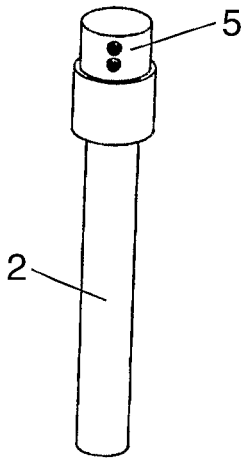
FIG. 6 is a perspective view of the header of the valve assembly of FIGS. 1-5, FIGS. 7 and 8 are side views of the header of FIG. 6.

FIG. 6 is a perspective view of a header 2 of the valve assembly of FIGS. 1-3, with the distributor part 4 arranged in the interior thereof. Only the inlet section 5 of the distributor part 4 is visible.

Figure 7:
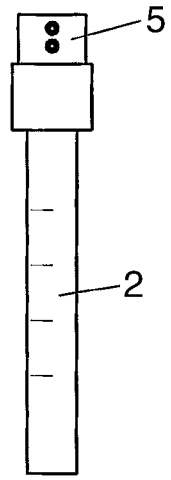
Figure 8:
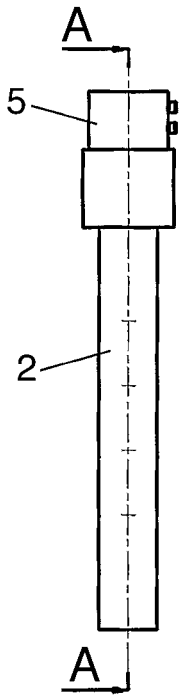

FIGS. 7 and 8 are side views of the header 2 of FIG. 6, seen from two different angles.

Figure 9:
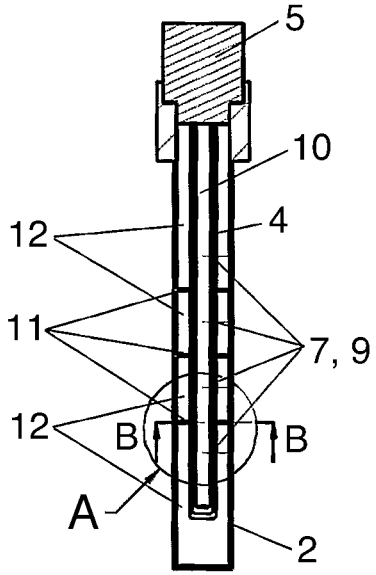
FIG. 9 is a cross sectional view of the header of FIG. 8 along the line A-A.

FIG. 9 is a cross sectional view of the header 2 of FIGS. 6-8 along the line A-A shown in FIG. 8. It can be seen that the openings 7, 9 are arranged substantially at corresponding positions. In FIG. 9 it can further be seen that the header 2 is provided with three separating parts 11, defining four sections 12 of the header 2. The separating parts 11 have an annular shape, allowing the distributor part 4 to pass through an opening in a centre part of each separating part 11. The separating parts 11 may be arranged in a sealing manner in the header 2, in which case fluid is not allowed to pass between the sections 12. Alternatively, the interfaces between the separating parts 11 and the header 2 may not be completely fluid tight, thereby allowing fluid to pass between neighbouring sections 12 to a certain extent. However, since the pressure on either side of a separating part 11 must be expected to be substantially identical, only a limited amount of fluid will normally pass to a neighbouring section 12.

Each of the pairs of openings 7, 9 interconnects the interior channel 10 with one of the sections 12. Each of the sections 12 is further connected to one or more flow channels of the heat exchanger (not shown). Thus, fluid which has been guided into a given section 12 will flow into the flow channel(s) of the heat exchanger which are connected to that specific section 12.

A valve assembly comprising the header 2 of FIG. 9 is preferably operated in the following manner. Fluid medium in a liquid state is supplied to the valve assembly via the inlet section 5 of the distributor part 4, thereby entering the interior channel 10. The fluid medium is then distributed to the sections 12 via the openings 7, 9. During this the fluid medium is expanded as described above, i.e. fluid medium in a mixed liquid/gaseous state enters each of the sections 12. Thereby it is obtained that the liquid/gaseous mixture which enters each of the sections 12 is substantially identical. Thus, when the fluid medium is subsequently distributed further on towards the flow channels of the heat exchanger, the distribution of liquid/gaseous fluid medium among the flow channels is substantially uniform. Thereby the heat exchanging capacity of the heat exchanger can be utilised to the greatest possible extent.

Figure 10:
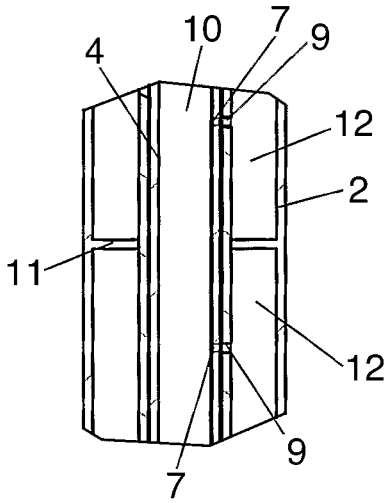
FIG. 10 is a detail of the header of FIG. 9.

FIG. 10 is a detail of the header 2 of FIG. 9 as indicated by the circle A shown in FIG. 9. In FIG. 10 it is clearly seen that pairs of the openings 7, 9 are arranged at corresponding positions, thereby forming a passage between the interior channel 10 and a corresponding section 12. It can also be seen that the openings 7, 9 are arranged at a distance from the separating parts 11, preferably substantially half way between two adjacent separating parts 11. Thereby it is obtained that the fluid medium entering a given section 12 is distributed substantially uniformly between the flow channels of the heat exchanger which are connected to the section 12.

Figure 11:
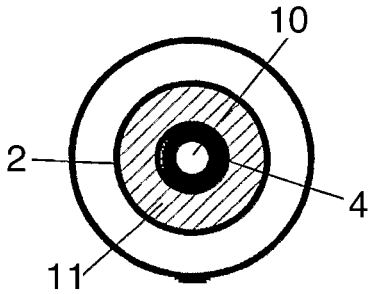
FIG. 11 is a cross sectional view of the header of FIG. 9 along the line B-B.

FIG. 11 is a cross sectional view of the header 2 of FIG. 9 along the line B-B. FIG. 11 shows how one of the separating parts 11 is arranged in the header 2.

While the present invention has been illustrated and described with respect to a particular embodiment thereof, it should be appreciated by those of ordinary skill in the art that various modifications to this invention may be made without departing from the spirit and scope of the present.

The invention claimed is:

1. A valve assembly comprising:

an interior channel adapted to receive fluid medium in a liquid state, a distributor part comprising an inlet section fluidly connected to the interior channel, the distributor part being arranged to distribute fluid medium received from the interior channel to at least two parallel flow paths of a heat exchanger, an elongated section and a header comprising at least two openings constituting a pair of openings, each opening being adapted to deliver a fluid medium leaving the header in an at least partly gaseous state, the distributor part forming a first valve part and the header forming a second valve part arranged movable relative to each other in such a manner that the mutual position of the valve parts determines an overlap between the pair of openings and determines the fluid medium flow from the interior channel to each of the openings of the elongated section and the header, the header forming an integral part of the valve assembly, said header being arranged to form an interface towards the heat exchanger comprising the at least two parallel flow paths, and said header providing fluid passage in such a manner that each of the openings is arranged to pass fluid medium to a flow path of the heat exchanger connected to the header, wherein the header comprises one or more separating parts defining at least two sections of the header, each of said sections being fluidly connected to the distributor part through each of the pairs of holes and the interior channel and being connected to one or more flow channels of the heat exchanger through the header being arranged to form the interface towards the heat exchanger.

2. The valve assembly according to claim 1, wherein the header forms part of a distributor.

3. The valve assembly according to claim 1, wherein the distributor part forming the first valve part comprises a plurality of openings and the header forming the second valve part comprises at least one opening, and wherein the fluid medium flow from the interior channel to each of the openings is determined by a mutual position of the openings of the first valve part and the opening(s) of the second valve part.

4. The valve assembly according to claim 3, wherein the mutual position of the openings determines a degree of opening of the valve assembly.

5. The valve assembly according to claim 3, wherein the mutual position of the openings determines a distribution of fluid flow among the openings.

6. The valve assembly according to claim 3, wherein at least some of the openings are microchannels.

7. The valve assembly according to claim 1, wherein the first valve part and the second valve part are adapted to perform substantially linear relative movements.

8. The valve assembly according to claim 1, wherein the first valve part and the second valve part are adapted to perform substantially rotational relative movements.

9. The valve assembly according to claim 1, further comprising an actuator adapted to cause relative movements of the first valve part and the second valve part.

10. The valve assembly according to claim 1, wherein each of the sections is fluidly connected to at least one microchannel.

11. The valve assembly according to claim 1, wherein each of the sections is connected to at least two outlet openings.

* * * * *